US010175626B2

(12) United States Patent
Akasaka

(10) Patent No.: US 10,175,626 B2
(45) Date of Patent: Jan. 8, 2019

(54) FEEDING DEVICE

(71) Applicant: CANON KABUSHIKI KAISHA, Tokyo (JP)

(72) Inventor: Eiji Akasaka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/678,554

(22) Filed: Aug. 16, 2017

(65) Prior Publication Data

US 2018/0059608 A1 Mar. 1, 2018

(30) Foreign Application Priority Data

Aug. 31, 2016 (JP) ..... 2016-169372

(51) Int. Cl.
*G03G 15/00* (2006.01)
*B65H 1/02* (2006.01)

(52) U.S. Cl.
CPC ..... *G03G 15/6529* (2013.01); *G03G 15/6514* (2013.01); *B65H 1/027* (2013.01); *G03G 2215/00392* (2013.01)

(58) Field of Classification Search
CPC ..... G03G 15/6502; G03G 15/6511; G03G 15/6514; G03G 2215/00383; G03G 2215/00392; B65H 1/025; B65H 1/027
See application file for complete search history.

(56) References Cited

U.S. PATENT DOCUMENTS 5,008,715 A * 4/1991 Imaizumi ..... G03G 15/6502 399/392

FOREIGN PATENT DOCUMENTS

| | | | |
|---|---|---|---|
| JP | 05097294 A | * | 4/1993 |
| JP | 05-186063 A | | 7/1993 |
| JP | 2009256069 A | | 11/2009 |
| JP | 2014162629 A | | 9/2014 |
| JP | 2015199580 A | | 11/2015 |

OTHER PUBLICATIONS

Kusano et al. (JP 05-097294 A), Apr. 1993, JPO Computer Translation.*

* cited by examiner

*Primary Examiner* — Erika J Villaluna

(74) *Attorney, Agent, or Firm* — Canon U.S.A., Inc. IP Division

(57) ABSTRACT

A feeding device includes a detection unit, a control unit, a first plate on which a recording material is placed, a second plate located above the first plate in vertical direction, and an uplift unit to uplift a recording material placed on the first plate. The detection unit changes a detection result when an uplifted recording material arrives at a feeding position. The recording material placed on the first plate is uplifted by the uplift unit until the detection result is changed. The detection result is changed when a recording material fed from the second plate passes the detection unit while the recording material placed on the first plate is not in the feeding position. The control unit causes recording material to be sequentially fed from the second plate, and causes the uplift unit to uplift the recording material placed on the first plate in an interval time.

8 Claims, 10 Drawing Sheets

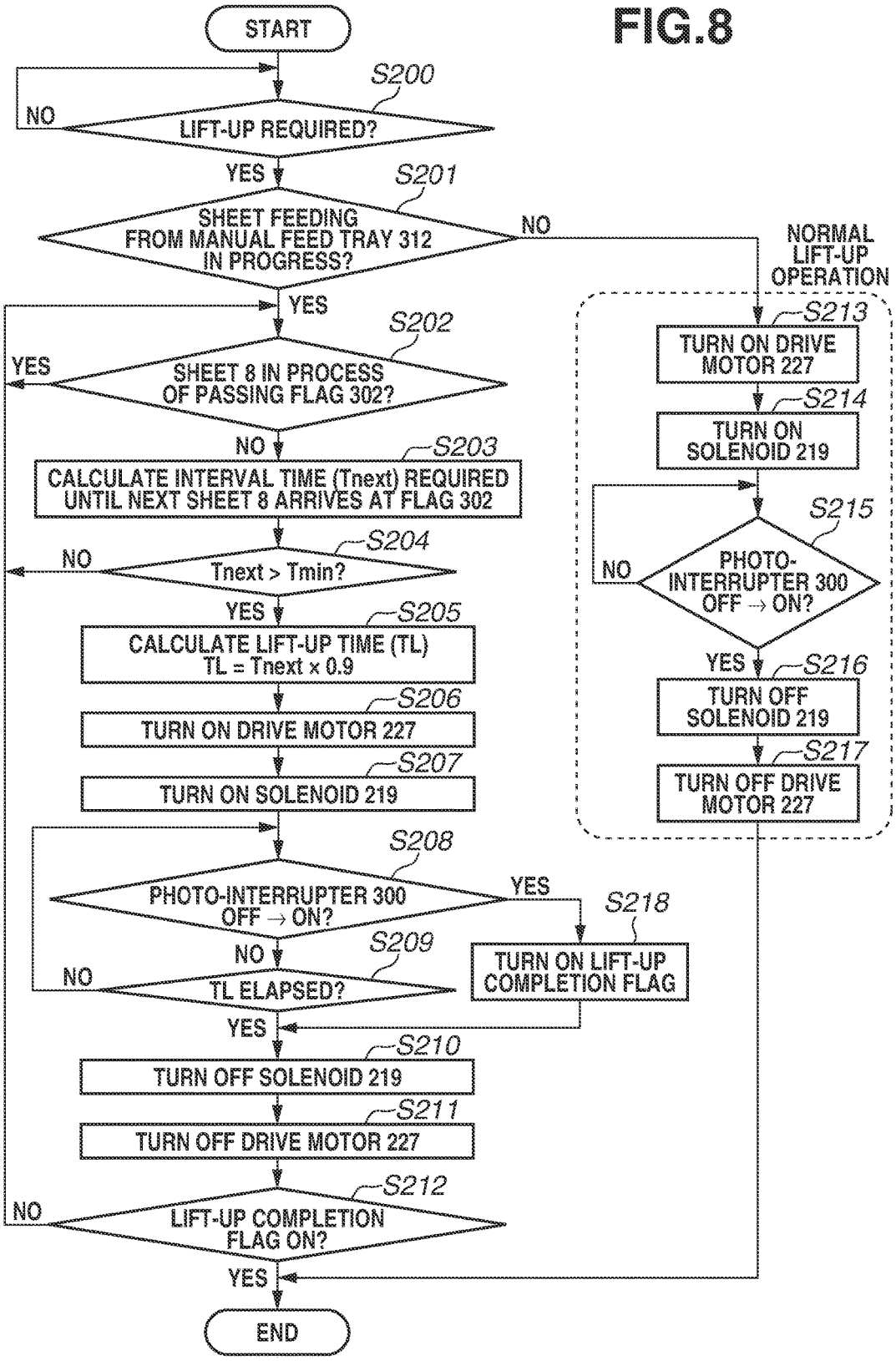
FIG.8
START
S200
LIFT-UP REQUIRED?
NO
YES
S201
SHEET FEEDING FROM MANUAL FEED TRAY 312 IN PROGRESS?
NO
NORMAL LIFT-UP OPERATION
YES
S202
SHEET 8 IN PROCESS OF PASSING FLAG 302?
YES
NO
S203
CALCULATE INTERVAL TIME (Tnext) REQUIRED UNTIL NEXT SHEET 8 ARRIVES AT FLAG 302
S204
Tnext > Tmin?
NO
YES
S205
CALCULATE LIFT-UP TIME (TL)
TL = Tnext × 0.9
S206
TURN ON DRIVE MOTOR 227
S207
TURN ON SOLENOID 219
S208
PHOTO-INTERRUPTER 300 OFF → ON?
YES
S218
TURN ON LIFT-UP COMPLETION FLAG
NO
S209
TL ELAPSED?
NO
YES
S210
TURN OFF SOLENOID 219
S211
TURN OFF DRIVE MOTOR 227
S212
LIFT-UP COMPLETION FLAG ON?
NO
YES
END
S213
TURN ON DRIVE MOTOR 227
S214
TURN ON SOLENOID 219
S215
PHOTO-INTERRUPTER 300 OFF → ON?
NO
YES
S216
TURN OFF SOLENOID 219
S217
TURN OFF DRIVE MOTOR 227

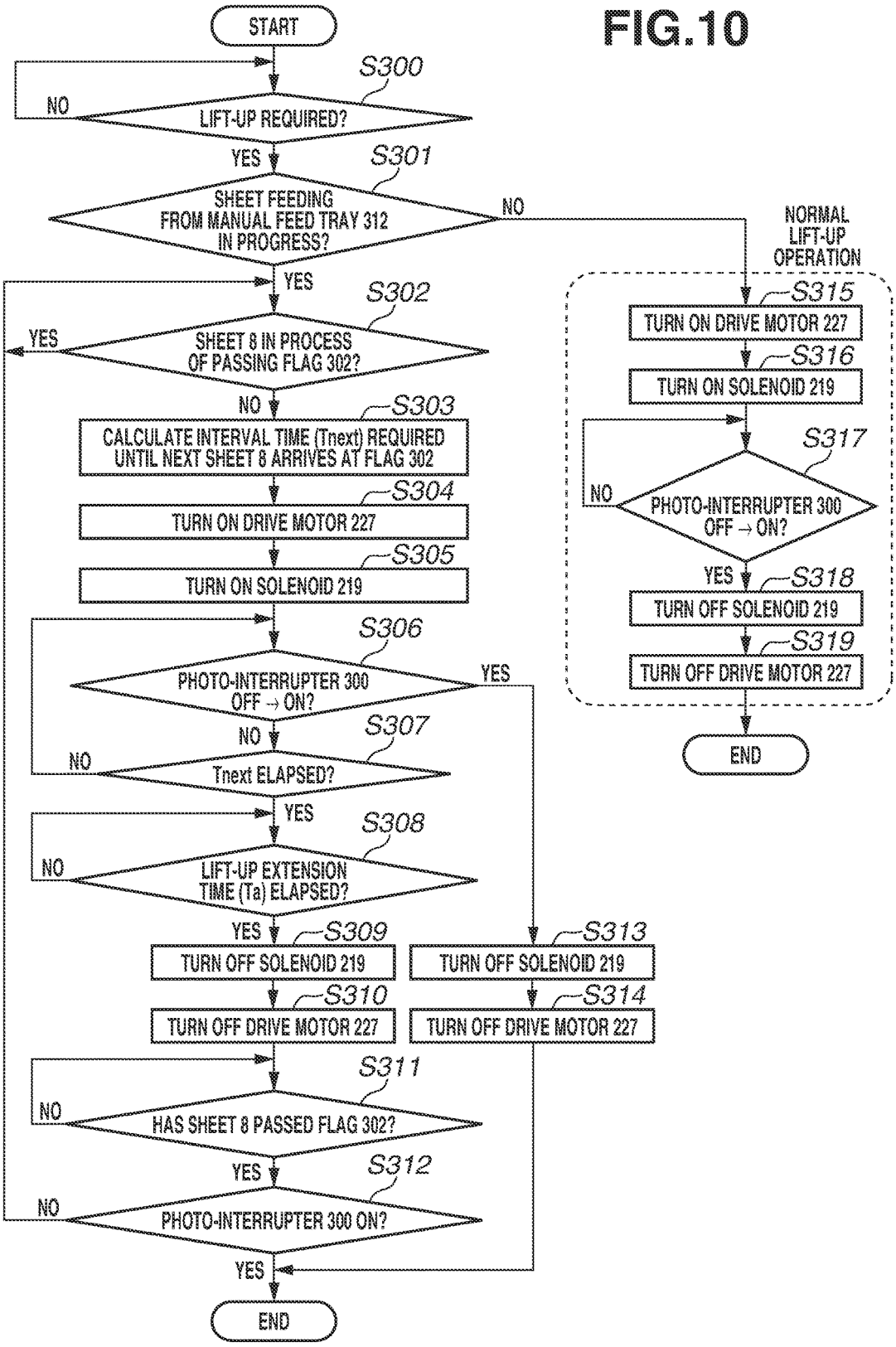
FIG.10
START
S300
LIFT-UP REQUIRED?
NO
YES
S301
SHEET FEEDING FROM MANUAL FEED TRAY 312 IN PROGRESS?
NO
NORMAL LIFT-UP OPERATION
YES
S302
SHEET 8 IN PROCESS OF PASSING FLAG 302?
YES
NO
S303
CALCULATE INTERVAL TIME (Tnext) REQUIRED UNTIL NEXT SHEET 8 ARRIVES AT FLAG 302
S304
TURN ON DRIVE MOTOR 227
S305
TURN ON SOLENOID 219
S306
PHOTO-INTERRUPTER 300 OFF → ON?
YES
NO
S307
Tnext ELAPSED?
NO
YES
S308
LIFT-UP EXTENSION TIME (Ta) ELAPSED?
NO
YES
S309
TURN OFF SOLENOID 219
S310
TURN OFF DRIVE MOTOR 227
S313
TURN OFF SOLENOID 219
S314
TURN OFF DRIVE MOTOR 227
S311
HAS SHEET 8 PASSED FLAG 302?
NO
YES
S312
PHOTO-INTERRUPTER 300 ON?
NO
YES
END
S315
TURN ON DRIVE MOTOR 227
S316
TURN ON SOLENOID 219
S317
PHOTO-INTERRUPTER 300 OFF → ON?
NO
YES
S318
TURN OFF SOLENOID 219
S319
TURN OFF DRIVE MOTOR 227
END

FEEDING DEVICE

BACKGROUND OF THE INVENTION

Field of the Invention

The disclosed information generally relates to a feeding device having a plurality of feeding ports through which to feed a recording material.

Description of the Related Art

Some conventional feeding devices each included in, for example, a copying machine or a printer are equipped with a lifter mechanism which uplifts sheets placed on a cassette. Such a feeding device is provided with a sheet surface sensor which detects that the sheets uplifted by the lifter mechanism have arrived at a sheet feeding position, and the lifter mechanism uplifts the sheets placed on the cassette until the result of detection by the sheet surface sensor changes. This allows the position of sheets to be kept almost constant and also allows a pick-up roller to stably feed a sheet at an optimal pressure. Furthermore, some sheet feeding ports other than cassettes include a manual feed tray. The manual feed tray is configured to allow a plurality of sheets to be placed thereon, and has a benefit in that various sizes of sheets are allowed to be fed without the user bothering to replace sheets placed on the cassette.

Japanese Patent Application Laid-Open No. 2009-256069 discusses a feeding device equipped with a cassette and a manual feed tray as a plurality of sheet feeding ports. In the feeding device discussed in Japanese Patent Application Laid-Open No. 2009-256069, the cassette and the manual feed tray are located very close to each other in vertical direction for the purpose of miniaturization, and the respective conveyance paths thereof join together at a position more upstream than a separation mechanism for sheets. In other words, the feeding device has such a configuration that a sheet fed from the manual feed tray is conveyed to a space between the uppermost sheet placed on the cassette and the pick-up roller.

Here, as mentioned above, the lifter mechanism needs to be equipped with the sheet surface sensor. Since the sheet surface sensor is located near the pick-up roller, in the case of the configuration discussed in Japanese Patent Application Laid-Open No. 2009-256069, the sheet surface sensor would react to a sheet fed from the manual feed tray. Accordingly, during a period when a sheet fed from the manual feed tray is passing a detecting position of the sheet surface sensor, the sheet surface sensor is not able to detect that the sheets placed on the cassette have arrived at the sheet feed position. Therefore, in a case where the user has performed an opening and closing operation on the cassette during a period when a plurality of sheets is being fed from the manual feed tray, a lift-up operation for raising the sheets placed on the cassette is not immediately started, but the lift-up operation is started after a sheet feeding operation from the manual feed tray is completed. However, in a case where an instruction to feed a sheet from the cassette immediately after the sheet feeding operation from the manual feed tray is completed has been issued, downtime due to the lift-up operation may be caused before an instruction for sheet feeding from the cassette is carried out.

SUMMARY OF THE INVENTION

The disclosed information is generally directed to reducing downtime due to the lift-up operation in the case of starting a sheet feeding operation from a cassette.

According to an aspect of the present invention, a feeding device includes a first plate on which a recording material is placed, a second plate located above the first plate in vertical direction, an uplift unit configured to uplift a recording material placed on the first plate, a detection unit configured to change a detection result in response to the recording material uplifted by the uplift unit arriving at a feeding position, wherein the recording material placed on the first plate is uplifted by the uplift unit until the detection result is changed, wherein the detection result is changed when a recording material fed from the second plate passes the detection unit while the recording material placed on the first plate is not in the feeding position, and a control unit configured to cause a first recording material and a second recording material to be sequentially fed from the second plate, and to cause the uplift unit to uplift the recording material placed on the first plate in an interval time from when at least a trailing edge of the first recording material passes the detection unit to when a leading edge of the second recording material arrives at the detection unit.

Further features of the present invention will become apparent from the following description of embodiments with reference to the attached drawings.

BRIEF DESCRIPTION OF THE DRAWINGS

FIG. 8 is a flowchart illustrating the lift-up control according to the second embodiment.

FIG. 10 is a flowchart illustrating the lift-up control according to the third embodiment.

DESCRIPTION OF THE EMBODIMENTS

Figure 1:
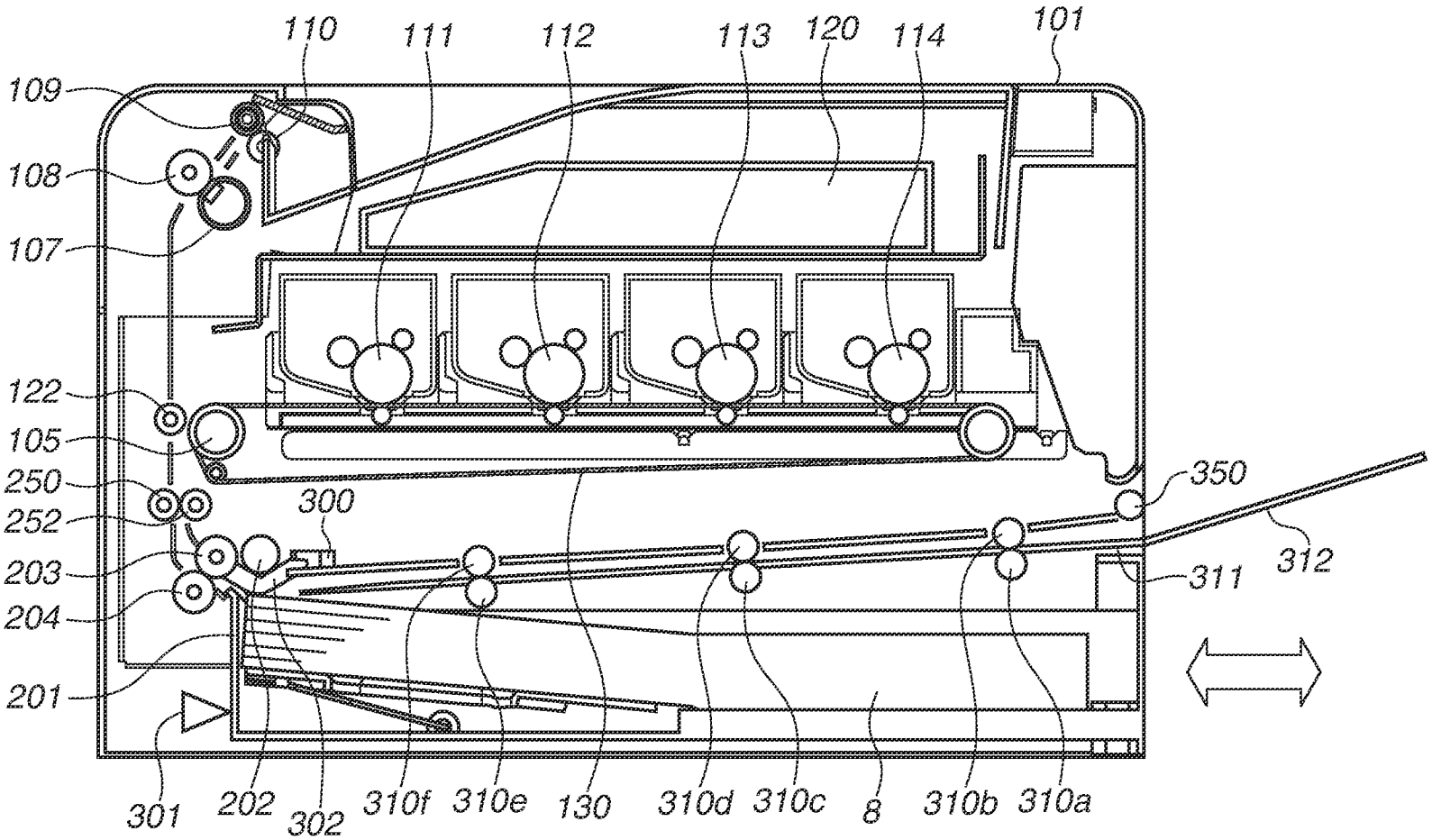
FIG. 1 is a schematic sectional view of an image forming apparatus.

In a first embodiment, a method of performing lift-up in a case where an interval at which sheets are fed from a manual feed tray is longer than the maximum time required for a lift-up operation in a cassette is described.

[Overall Configuration of Image Forming Apparatus]

An overall configuration of an image forming apparatus (a feeding device) is described with reference to FIG. 1. In the present embodiment, a laser beam printer is illustrated as an example of the image forming apparatus. A laser beam printer 101 (hereinafter referred to as a "printer 101") includes a cassette 201 (a first plate), on which sheets 8 are placed. The cassette 201 is detachably attachable to the printer 101 along a double-headed arrow illustrated in FIG. 1. A sheet 8 (a recording material) placed on the cassette 201 is fed by a pick-up roller 202, which rotates clockwise as viewed in FIG. 1. Then, the fed sheet 8 is conveyed to a nip portion between a conveyance roller 250 and a conveyance counter roller 252 and is then conveyed to a transfer nip portion between an intra-belt roller 105 and a transfer roller 122.

Photosensitive drums 111 to 114 (image bearing members) each of which configures an image forming unit rotate counterclockwise as viewed in FIG. 1. In the image forming units, outer circumferential surfaces of the respective photosensitive drums 111 to 114 are irradiated with laser beams emitted from a laser scanner 120, so that electrostatic latent images are sequentially formed on the outer circumferential surfaces. Then, the electrostatic latent images are developed by development rollers and are formed into toner images. The toner images formed on the photosensitive drums 111 to 114 are transferred to an intermediate transfer belt 130 (an intermediate transfer member). In the case of forming a color image, toner images of colors yellow, magenta, cyan, and black are respectively formed on the photosensitive drums 111 to 114, and the respective formed toner images are sequentially transferred to the intermediate transfer belt 130. Next, the toner images formed on the intermediate transfer belt 130 are collectively transferred to the sheet 8 conveyed to the transfer nip portion.

The sheet 8 having the toner images transferred thereto is conveyed to a fixing nip portion between a fixing film 107 and a pressure roller 108 and is then heated and pressed there, so that the toner images are fixed to the sheet 8. The sheet 8 having the toner images fixed thereto is discharged by a discharge roller 109 and a discharge counter roller 110. Moreover, the printer 101 includes a manual feed tray 312 (a second plate), which is a sheet feeding port different from the cassette 201. Details of the manual feed tray 312 are described below.

[System Configuration of Image Forming Apparatus]

Figure 2:
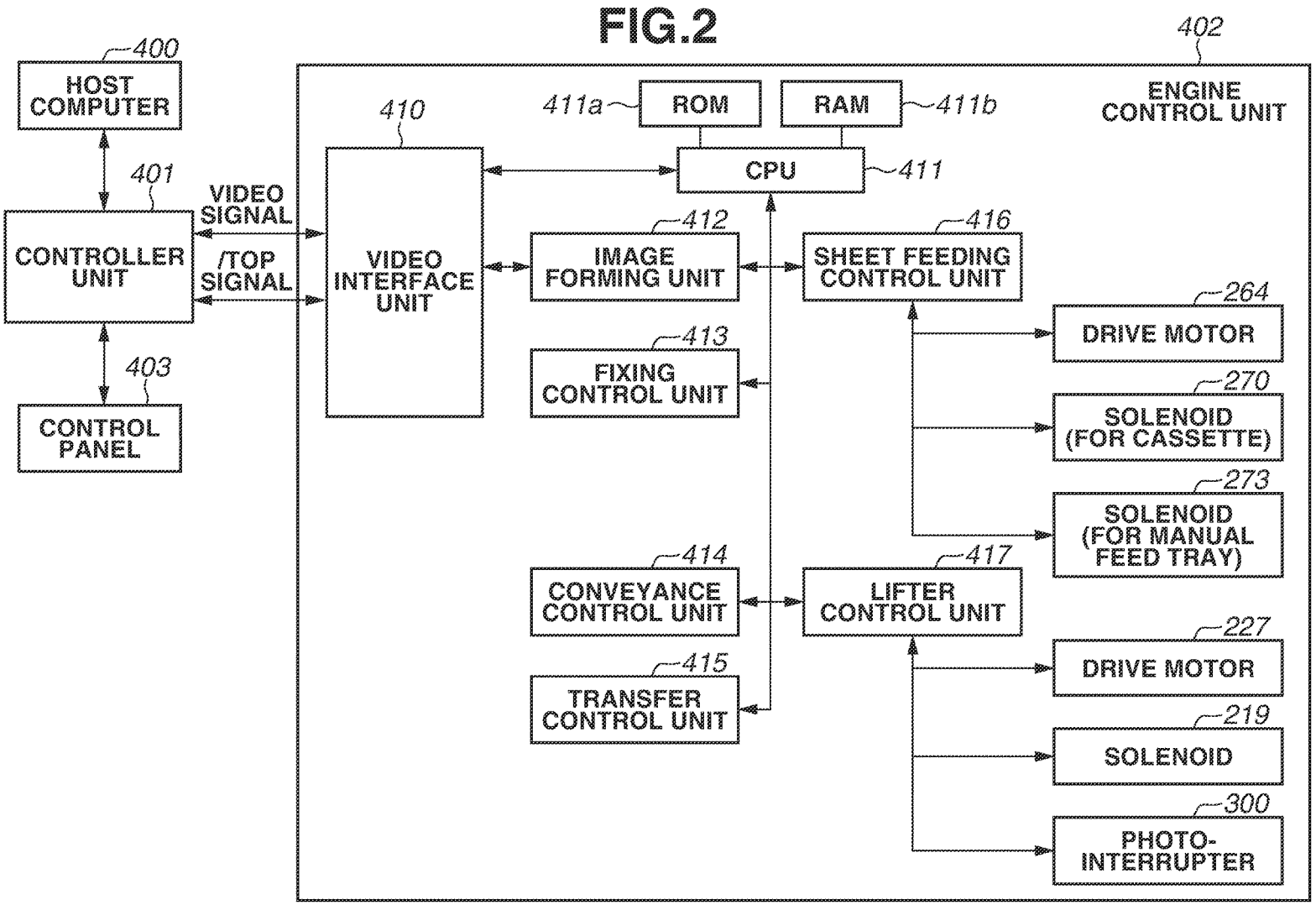
FIG. 2 is a block diagram illustrating a system configuration of the image forming apparatus.

FIG. 2 is a system configuration diagram of the printer 101. A controller unit 401 is configured to be able to mutually communicate with each of a host computer 400, an engine control unit 402, and a control panel 403.

When receiving image information and a printing instruction from the host computer 400, the controller unit 401 analyzes and converts the received image information into bit data. Then, the controller unit 401 transmits a printing reservation command, a printing start command, and a video signal to the engine control unit 402 via a video interface unit 410 with respect to each sheet 8. Moreover, the controller unit 401 displays, for example, information about the status of the printer 101 on the control panel 403 to inform the user.

The controller unit 401 transmits a printing reservation command, which indicates a printing condition generated by the host computer 400 in a printing order, to the engine control unit 402. Moreover, the controller unit 401 transmits a printing start command to the engine control unit 402 at timing when the printer 101 becomes ready to print.

In a case where the amount of image information transmitted from the host computer 400 is large, analytical processing performed by the controller unit 401 is time-consuming. Therefore, the controller unit 401 analyzes image information received from the host computer 400 and then transmits a predicted time, which is a time required to start transmitting a printing start command, as a printing start notice command to the engine control unit 402.

The engine control unit 402 makes preparations for performing a printing operation in an order indicated by the printing reservation command received from the controller unit 401, and waits until receiving the printing start command transmitted from the controller unit 401. Upon receiving the printing start command from the controller unit 401, the engine control unit 402 outputs a /TOP signal, which serves as reference timing for outputting of a video signal, to the controller 401, and starts a printing operation according to the received printing reservation command.

A central processing unit (CPU) 411 included in the engine control unit 402 individually controls an image forming unit 412, a fixing control unit 413, a conveyance control unit 414, a transfer control unit 415, a sheet feeding control unit 416, and a lifter control unit 417 to perform image forming processing required for the printing operation. The sheet feeding control unit 416 is configured with a drive motor 264, a solenoid 270 (for the cassette 201), and a solenoid 273 (for the manual feed tray 312). The lifter control unit 417 is configured with a drive motor 227, a solenoid 219, and a photo-interrupter 300. The CPU 411 controls the above-mentioned members, while using a random access memory (RAM) 411*b* as a work area, according to various programs stored in a read-only memory (ROM) 411*a*.

[Method of Feeding Sheet 8 from Cassette 201]

Figure 3A:
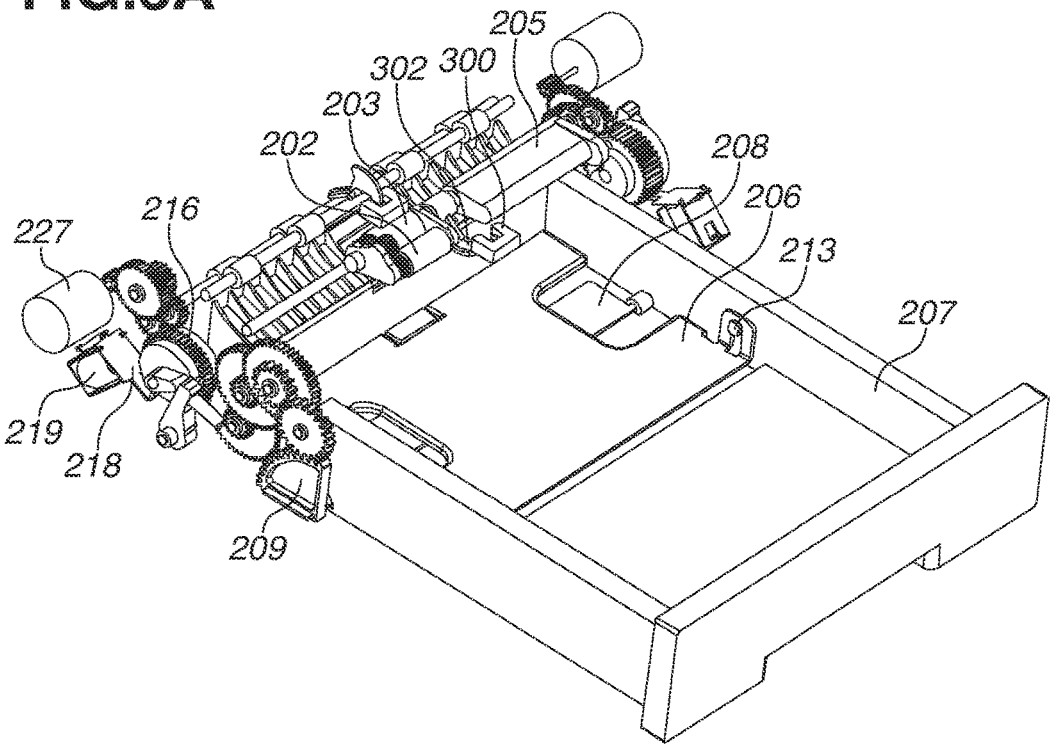
FIGS. 3A and 3B are external perspective views of a sheet feeding device according to a first embodiment.
Figure 3B:
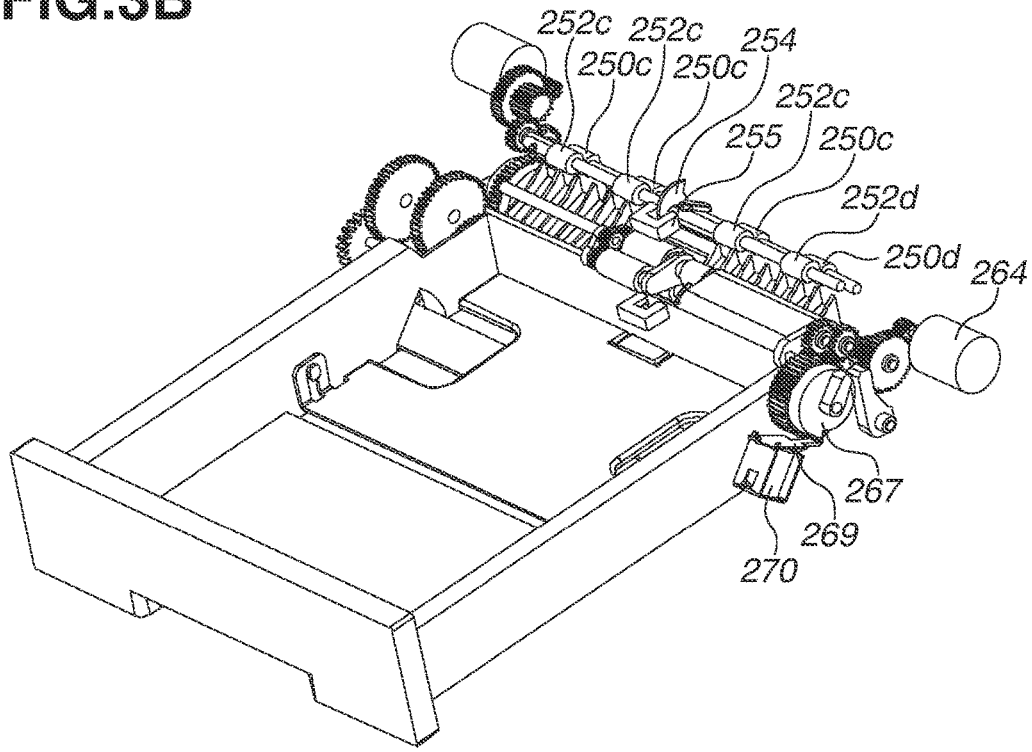

FIGS. 3A and 3B are perspective views of the cassette 201 in the present embodiment. FIG. 3A is a perspective view as viewed from a lifter driving side, and FIG. 3B is a perspective view as viewed from a sheet feeding driving side.

Members mainly associated with a lift-up operation in the cassette 201 are illustrated in FIG. 3A. The cassette 201 includes a frame 207, a bottom plat 206, which is attached to the frame 207 and is swingable with respect to the frame 207, and a lift arm 208, which is arranged to uplift the bottom plate 206. To uplift the bottom plate 206, the CPU 411 causes the drive motor 227 to rotate, applies a voltage to the solenoid 219, and releases a restriction on a partially untoothed gear 216. After the release, drive is transmitted to the downstream side to cause the lift arm 208 to rotate together with a lift arm drive gear 209, so that the bottom plate 206 having sheets 8 stacked thereon is rotated around a rotational shaft 213.

Figure 4A:
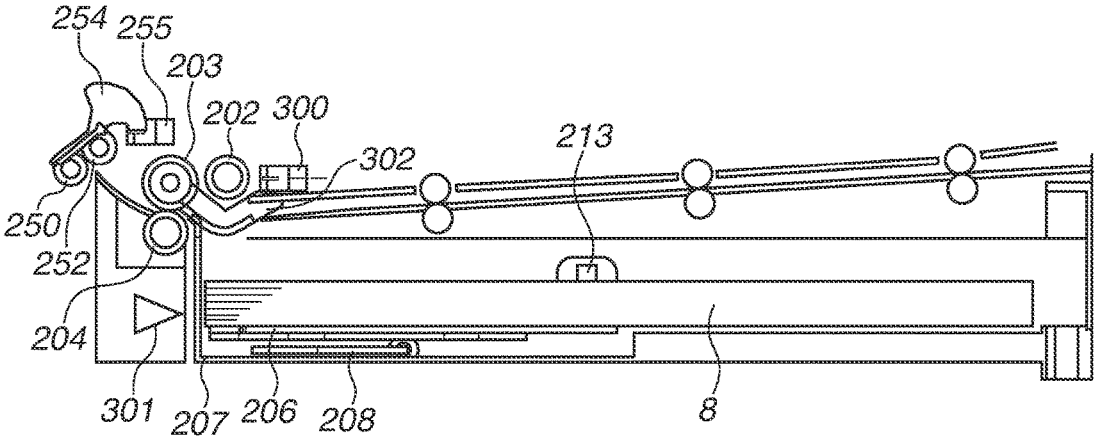
FIGS. 4A, 4B, and 4C are sectional views of the sheet feeding device according to the first embodiment.

Next, a lift-up operation for stopping the uplifted bottom plate 206 at a predetermined height is described. FIG. 4A is a sectional view illustrating a state in which the cassette 201 having sheets 8 stacked thereon is mounted in the printer 101. A flag 302 contacts the sheet surface of a sheet 8 located uppermost when the sheets 8 are uplifted. Then, when being pushed upward by the sheet 8, the flag 302 rotates around the shaft of a feed roller 203. Moreover, according to the position of the flag 302, a signal output from the photo-interrupter 300 (a detection result) is switched to ON (a light-blocked state) or OFF (a light-transmitted state). In FIG. 4A, the pick-up roller 202 is retracted upward, the flag 302 droops downward under its own weight, and the photo-interrupter 300 is in an off state.

Figure 4B:
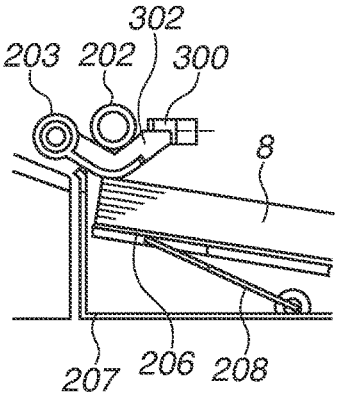

When a cassette presence or absence detection sensor 301 detects that the cassette 201 has been attached, the CPU 411 drives the drive motor 227 and the solenoid 219 to uplift the bottom plate 206. The bottom plate 206 rises, the sheet 8 located uppermost pushes up the flag 302, and a signal output from the photo-interrupter 300 is changed from OFF to ON, as illustrated in FIG. 4B. The CPU 411 turns off the solenoid 219 and stops the drive motor 227 at timing when the signal output from the photo-interrupter 300 is changed from OFF to ON.

Figure 4C:
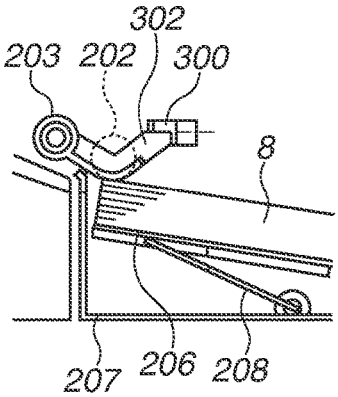

The above-described control operation allows uplifting the bottom plate 206 to an optimum height. Furthermore, when the bottom plate 206 is at the optimum height, the sheet 8 located uppermost is in a sheet feeding position (a feeding position). Here, the sheet feeding position refers to a position in which the pick-up roller 202 can stably feed the sheet 8 at an optimum nip pressure. FIG. 4C illustrates a state in which an operation of feeding the sheet 8 is started from the state illustrated in FIG. 4B.

Members mainly associated with the sheet feeding operation in the cassette 201 are illustrated in FIG. 3B. When the CPU 411 drives the drive motor 264 and turns on the solenoid 270 for a predetermined time, a restriction on a rotation restricting member 269 for a partially untoothed gear 267 is released. With this, a supporting member 205 which supports the pick-up roller 202 rotates around the shaft of the feed roller 203 to bring the pick-up roller 202, which has been retracted upward, into contact with the sheet 8. Then, the pick-up roller 202 is rotated, so that the sheet 8 is fed.

The fed sheet 8 is conveyed to a separation nip portion between the feed roller 203 and a retard roller 204. In a case where two or more sheets 8 overlapping each other are fed by the pick-up roller 202, one sheet 8 is separated from the other sheets 8 at the separation nip portion and is then conveyed. The pick-up roller 202 is retracted upward until a next sheet feeding operation is performed. After passing through nip portions between conveyance rollers 250 (250*a* to 250*d*) and conveyance counter rollers 252 (252*a* to 252*d*), the sheet 8 contacts a conveyance flag 254. The conveyance flag 254 is rotated by contacting the leading edge of the sheet 8, so that a photo-interrupter 255 is changed from an off state to an on state. According to a signal output from the photo-interrupter 255 being changed, the CPU 411 is able to detect the leading edge of the sheet 8.

When the cassette 201 is detached from the printer 101, the bottom plate 206 descends, and, when the cassette 201 is re-attached to the printer 101, the bottom plate 206 enters a state illustrated in FIG. 4A. Thus, to feed a sheet 8 from the cassette 201, the lift-up operation is required to be re-performed.

[Method of Feeding Sheet 8 from Manual Feed Tray 312]

The manual feed tray 312 illustrated in FIG. 1 is located upper than the cassette 201 in vertical direction. The manual feed tray 312 allows sheets 8 to be inserted by the user.

When the CPU 411 drives the drive motor 264 and turns on the solenoid 273 for a predetermined time, a manual sheet feeding roller 350 contacts a sheet 8 and conveys the sheet 8. The sheet 8 is conveyed by conveyance rollers 310*a* to 310*f* toward the pick-up roller 202 along a conveyance guide 311. The sheet 8 meets the conveyance path of the cassette 201 just before the pick-up roller 202 and is then conveyed to a roller pair of the feed roller 203 and the retard roller 204.

Since, as mentioned above, the pick-up roller 202 is retracted upward except when a sheet 8 is fed from the cassette 201, the pick-up roller 202 does not need to be driven when a sheet 8 is conveyed from the manual feed tray 312. Moreover, even without the bottom plate 206 of the cassette 201 being uplifted, the sheet 8 is conveyed to a roller pair of the feed roller 203 and the retard roller 204 along the conveyance guide 311. An operation performed after that is similar to that performed when the sheet 8 is fed from the cassette 201.

Furthermore, in the present embodiment, to implement miniaturization of the printer 101, the cassette 201 and the manual feed tray 312 are located very close to each other in vertical direction. Then, the conveyance path of the manual feed tray 312 is configured to meet the conveyance path of the cassette 201 just before the pick-up roller 202, and the flag 302 is located on the conveyance path of the manual feed tray 312. Therefore, when a sheet 8 is fed from the manual feed tray 312, the sheet 8 pushes up the flag 302, so that a signal output from the photo-interrupter 300 is changed from OFF to ON.

[Method of Performing Lift-up Operation in Cassette 201 during Sheet Feeding from Manual Feed Tray 312]

Conventional Method

In a case where an opening and closing operation of the cassette 201 has been performed while a plurality of sheets 8 are sequentially fed from the manual feed tray 312, a lift-up operation in the cassette 201 is started after sheet feeding from the manual feed tray 312 is waited for to be completed. The reason for this is as mentioned below. The CPU 411 stops the lift-up operation of the bottom plate 206 at timing when the photo-interrupter 300 is changed from OFF to ON. Therefore, if the photo-interrupter 300 is changed from OFF to ON due to the sheet 8 fed from the manual feed tray 312, in spite of the fact that the lift-up operation is not yet completed, the CPU 411 would erroneously determine that the lift-up operation has been completed.

Method in Present Embodiment

Figure 5:
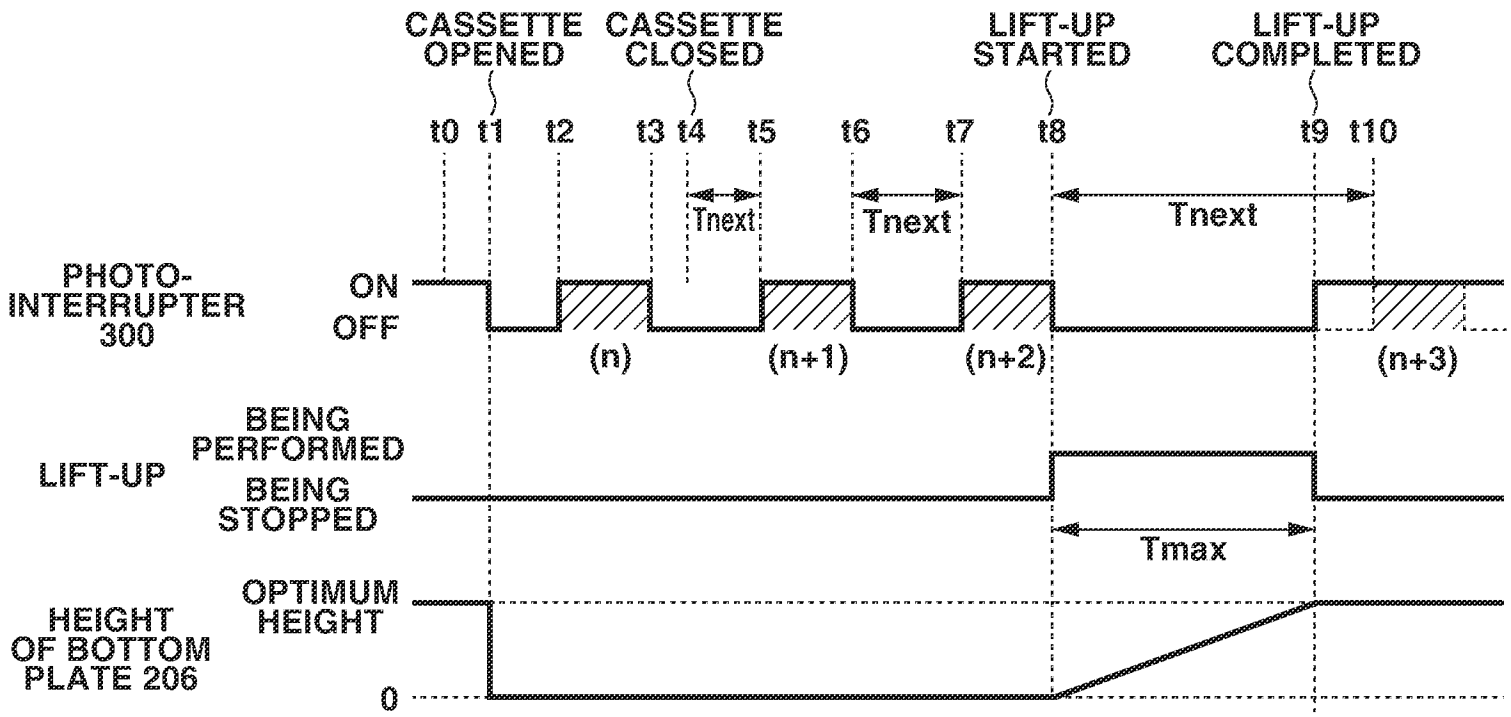
FIG. 5 is a timing chart illustrating lift-up control according to the first embodiment.

A method of performing a lift-up operation in the cassette 201 in the present embodiment is described with reference to the timing chart of FIG. 5. In FIG. 5, the abscissa axis indicates time elapsing.

At time point t0, the bottom plate 206 of the cassette 201 has been uplifted to the above-mentioned optimum height, so that the lift-up operation has already been completed. Thus, a signal output from the photo-interrupter 300 is ON. At time point t1, the cassette 201 is detached from the printer 101 by the user, the bottom plate 206 descends, and a signal output from the photo-interrupter 300 is changed to OFF. Under this state, a printing operation is performed with the use of the manual feed tray 312.

At time point t2, the leading edge of a sheet 8 (the n-th sheet) fed from the manual feed tray 312 arrives at the flag 302, so that a signal output from the photo-interrupter 300 is changed to ON. At time point t3, the trailing edge of the sheet 8 (the n-th sheet) passes the flag 302, so that a signal output from the photo-interrupter 300 is changed to OFF.

At time point t4, the cassette 201 is inserted into the printer 101 by the user. When the cassette presence or absence detection sensor 301 detects the insertion of the cassette 201, the CPU 411 calculates an interval time required until the leading edge of a next sheet 8 (the (n+1)-th sheet) arrives at the flag 302 (a time from time point t4 to time point t5, hereinafter referred to as a "time Tnext"). In a case where a printing start command has been received from the controller unit 401 without delay, the CPU 411 acquires an interval time from time point t3 to time point t5 from the ROM 411*a* (in the present embodiment, in the case of the speed of a 1 in 1 copy, 300 ms). In a case where analytical processing performed by the controller unit 401 is time-consuming and transmission of the printing start command is delayed, the CPU 411 calculates the time Tnext based on values of the printing start notice command.

Since, at time point t4, the printing start command has been received without delay, the CPU 411 calculates the time Tnext by acquiring an interval time from time point t3 to time point t5 from the ROM 411*a* and subtracting an elapsed time from time point t3 to time point t4 from the acquired interval time. The CPU 411 obtains a magnitude relationship between the time Tnext and a maximum time required for the lift-up operation (hereinafter referred to as a "time Tmax") by making a comparison therebetween. The maximum time required for the lift-up operation as used herein is a time required to perform lift-up control in the state in which no sheet 8 is set on the cassette 201, and is a constant previously stored in the ROM 411*a* (which is, in the present embodiment, set to 5 seconds). Then, if the following formula (1) is satisfied, since the lift-up operation can be completed before a signal output from the photo-interrupter 300 is changed to ON due to a sheet 8 fed from the manual feed tray 312, the CPU 411 starts the lift-up operation.

$$Tnext > Tmax \quad (1)$$

At time point t4, since formula (1) is not satisfied, the lift-up operation is not started. At time point t6, the trailing edge of the sheet 8 (the (n+1)-th sheet) passes the flag 302, and the CPU 411 calculates a time Tnext with respect to a next sheet 8 (the (n+2)-th sheet). Even at time point t6, since formula (1) is not satisfied, the lift-up operation is not started.

At time point t8, the trailing edge of the sheet 8 (the (n+2)-th sheet) passes the flag 302, and the CPU 411 calculates a time Tnext with respect to a next sheet 8 (the (n+3)-th sheet). With respect to the sheet 8 (the (n+3)-th sheet), analytical processing performed by the controller unit 401 has required more time and the interval time has become long, as illustrated in FIG. 5. The controller unit 401 notifies the engine control unit 402 of delaying of a printing start command with the use of a printing start notice command, and the CPU 411 delays sheet feeding timing of the sheet 8 (the (n+3)-th sheet). The CPU 411 calculates a time Tnext based on values of the printing start notice command (in the present embodiment, 6 seconds in this case), and, since formula (1) is satisfied, the CPU 411 starts a lift-up operation.

At time point t9, since a signal output from the photo-interrupter 300 is changed to ON, the CPU 411 determines that the bottom plate 206 has risen to the optimum height and stops the lift-up operation. At time point t10, the leading edge of the sheet 8 (the (n+3)-th sheet) arrives at the flag 302. However, since the photo-interrupter 300 is already in an on state, the signal thereof is not changed.

Figure 6:
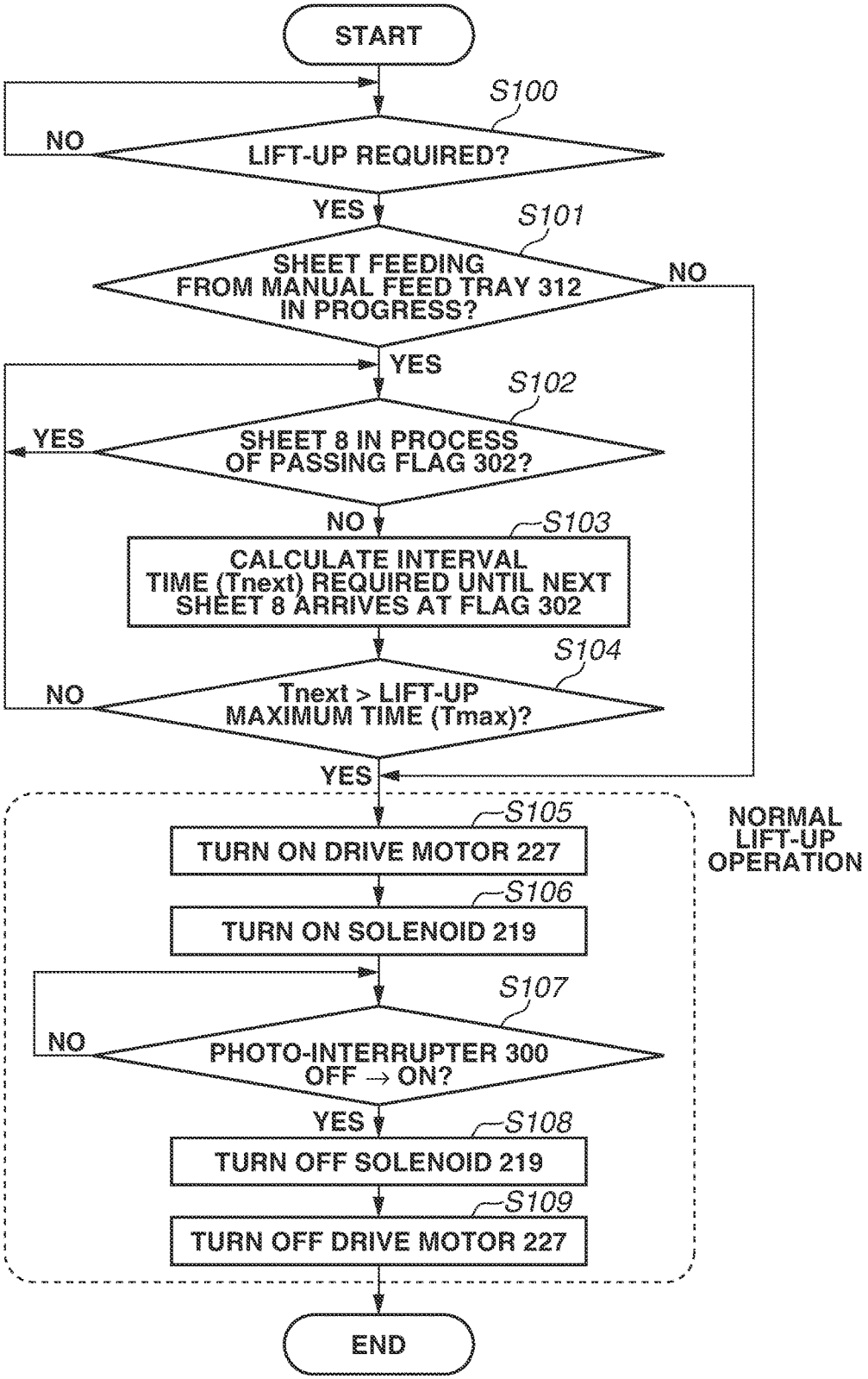
FIG. 6 is a flowchart illustrating the lift-up control according to the first embodiment.

The above-described operation is described with reference to the flowchart of FIG. 6. Control which is based on the flowchart of FIG. 6 is performed by the CPU 411 executing a program stored in, for example, the ROM 411*a*.

In step S100, the CPU 411 determines whether the cassette 201 has been inserted based on a signal output from the cassette presence or absence detection sensor 301 and thus determines whether lift-up is required. If it is determined that lift-up is required (YES in step S100), then in step S101, the CPU 411 determines whether sheet feeding from the manual feed tray 312 is in progress. If it is determined that sheet feeding from the manual feed tray 312 is in progress (YES in step S101), then in step S102, the CPU 411 determines whether a sheet 8 is in the process of passing the flag 302. If it is determined that a sheet 8 is not in the process of passing the flag 302 (NO in step S102), then in step S103, the CPU 411 calculates an interval time (Tnext) required until a next sheet 8 arrives at the flag 302. In step S104, the CPU 411 obtains a magnitude relationship between the interval time (Tnext) and a maximum time (Tmax) required for lift-up by making a comparison therebetween using the above-mentioned formula (1).

If formula (1) is not satisfied (NO in step S104), the CPU 411 repeats processing in steps S102 to S104. If formula (1) is satisfied (YES in step S104), the CPU 411 starts lift-up control. The CPU 411 turns on the drive motor 227 in step S105 and turns on the solenoid 219 in step S106. In step S107, the CPU 411 monitors a signal output from the photo-interrupter 300 being changed from OFF to ON. If the signal is changed to ON (YES in step S107), the CPU 411 determines that the bottom plate 206 has risen to the optimum height. Then, the CPU 411 turns off the solenoid 219 in step S108 and turns off the drive motor 227 in step S109. With this, the lift-up control ends.

Furthermore, if, in step S101, it is determined that sheet feeding from the manual feed tray 312 is not in progress (NO in step S101), the CPU 411 performs a lift-up operation in steps S105 to S109.

According to the above-described embodiment, since a lift-up operation in the cassette 201 can be completed during sheet feeding from the manual feed tray 312, downtime which would occur when the sheet feeding port is changed from the manual feed tray 312 to the cassette 201 can be reduced.

In the above-described first embodiment, a method of performing lift-up during sheet feeding from the manual feed tray 312 in a case where the interval time of a sheet fed from the manual feed tray 312 is longer than the maximum time required for lift-up in the cassette 201 has been described. In a second embodiment, a method of performing a lift-up operation divided into a plurality of operations is described. The description of main components such as those of the configuration is similar to that in the first embodiment, and, here, only portions different from those in the first embodiment are described.

Figure 7:
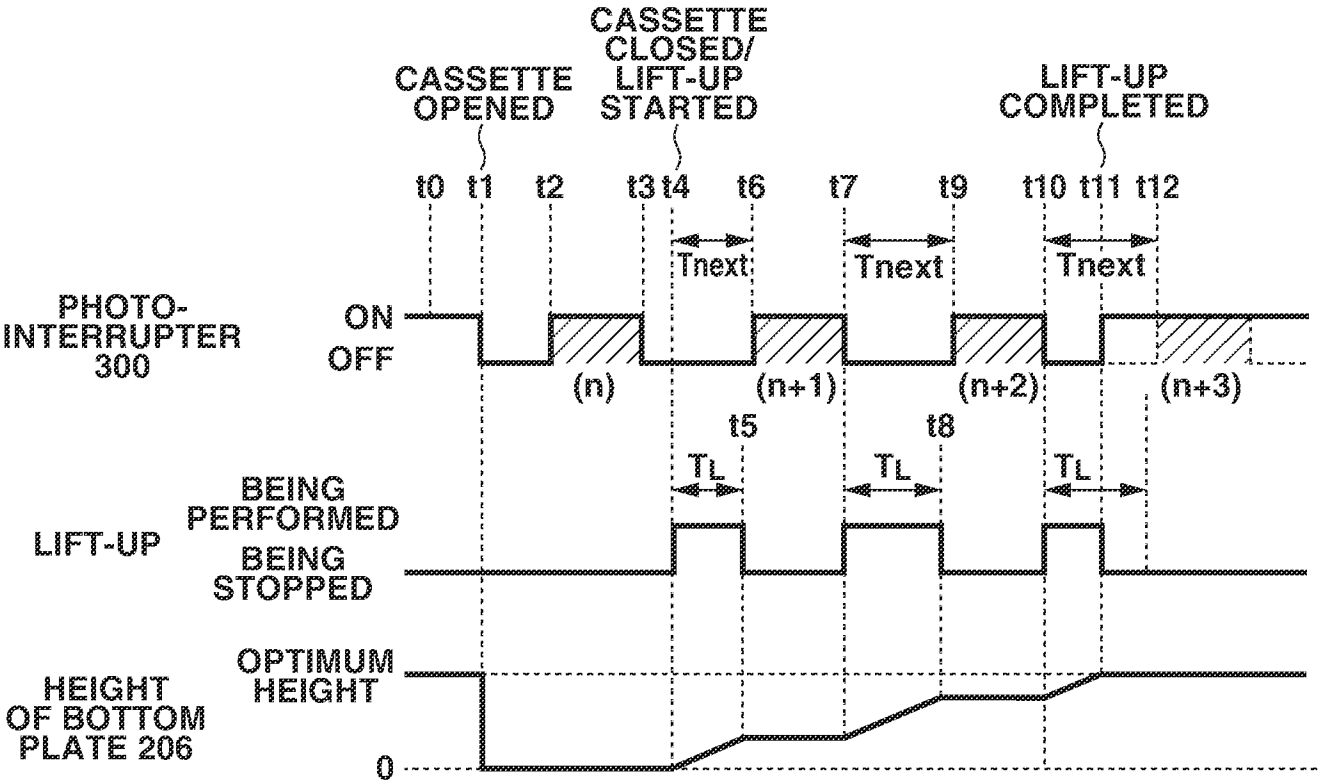
FIG. 7 is a timing chart illustrating lift-up control according to a second embodiment.

Lift-up control in the cassette 201 according to the second embodiment is described with reference to the timing chart of FIG. 7. In FIG. 7, the abscissa axis indicates time elapsing.

Operation performed until time point t4 is similar to that in the first embodiment, and is, therefore, omitted from description. At time point t4, the cassette 201 is inserted into the printer 101 by the user. When the cassette presence or absence detection sensor 301 detects the insertion of the cassette 201, the CPU 411 calculates an interval time (Tnext) required until the leading edge of a next sheet 8 (the (n+1)-th sheet) arrives at the flag 302. In the present embodiment, if the following formula (2) is satisfied, the CPU 411 starts lift-up at time point t4. Tmin denotes a time required from when the drive motor 227 is turned on to when the drive motor 227 reaches a steady-state speed, and is a constant stored in the ROM 411*a* (which is, in the present embodiment, set to 300 ms).

$$Tnext > Tmin \quad (2)$$

At time point T4, since formula (2) is satisfied, the CPU 411 turns on the drive motor 227, turns on the solenoid 219, and monitors a signal output from the photo-interrupter 300 being changed from OFF to ON. The CPU 411 performs a lift-up operation until timing slightly before the sheet 8 arrives at the flag 302, and calculates a lift-up time (TL) using the following formula (3).

$$TL = Tnext \times 0.9 \quad (3)$$

At time point t5, since the lift-up time TL has elapsed, the CPU 411 temporarily stops the lift-up operation. At time point t7, since the trailing edge of the sheet 8 (the (n+1)-th sheet) passes the flag 302, the CPU 411 calculates a time Tnext with respect to a sheet 8 (the (n+2)-th sheet). Since formula (2) is satisfied, the CPU 411 calculates the lift-up time TL using formula (3) and resumes lift-up.

At time point t8, since the lift-up time TL has elapsed, the CPU 411 temporarily stops the lift-up operation. At time point t10, since the trailing edge of the sheet 8 (the (n+2)-th sheet) passes the flag 302, the CPU 411 calculates a time Tnext with respect to a sheet 8 (the (n+3)-th sheet). Since formula (2) is satisfied, the CPU 411 calculates the lift-up time TL using formula (3) and resumes lift-up.

At time point t11, since it is detected that a signal output from the photo-interrupter 300 is changed from OFF to ON, the CPU 411 determines that the bottom plate 206 has risen to the optimum height and stops the lift-up operation. Thus, the CPU 411 stops the lift-up operation before the lift-up time TL elapses. At time point t12, the time Tnext elapses, and the leading edge of the sheet 8 (the (n+3)-th sheet) arrives at the flag 302. However, since the photo-interrupter 300 is already in an on state, the signal thereof is not changed.

The above-described operation is described with reference to the flowchart of FIG. 8. Control which is based on the flowchart of FIG. 8 is performed by the CPU 411 executing a program stored in, for example, the ROM 411*a*.

In step S200, the CPU 411 determines whether the cassette 201 has been inserted based on a signal output from the cassette presence or absence detection sensor 301 and thus determines whether lift-up is required. If it is determined that lift-up is required (YES in step S200), then in step S201, the CPU 411 determines whether sheet feeding from the manual feed tray 312 is in progress. If it is determined that sheet feeding from the manual feed tray 312 is in progress (YES in step S201), then in step S202, the CPU 411 determines whether a sheet 8 is in the process of passing the flag 302. If it is determined that a sheet 8 is not in the process of passing the flag 302 (NO in step S202), then in step S203, the CPU 411 calculates an interval time (Tnext) required until a next sheet 8 arrives at the flag 302.

In step S204, the CPU 411 determines whether formula (2) is satisfied. If it is determined that formula (2) is satisfied (YES in step S204), then in step S205, the CPU 411 calculates a lift-up time (TL) using formula (3). To start the lift-up operation, the CPU 411 turns on the drive motor 227 in step S206 and turns on the solenoid 219 in step S207. In step S208, the CPU 411 monitors a signal output from the photo-interrupter 300 being changed from OFF to ON. If it is determined that the signal output from the photo-interrupter 300 is OFF (NO in step S208), then in step S209, the CPU 411 determines whether the lift-up time TL has elapsed. If it is determined that the lift-up time TL has elapsed (YES in step S209), to temporarily stop the lift-up operation, the CPU 411 turns off the solenoid 219 in step S210 and turns off the drive motor 227 in step S211. In step S212, the CPU 411 determines whether a lift-up completion flag is ON, and, if it is determined that the lift-up completion flag is OFF (NO in step S212), the processing returns to step S202. The CPU 411 resumes the lift-up operation in steps S206 and S207, and, if a signal output from the photo-interrupter 300 is changed from OFF to ON (YES in step S208), the CPU 411 turns on the lift-up completion flag in step S218 and stops the lift-up operation in steps S210 and S211. If, in step S212, it is determined that the lift-up completion flag is ON (YES in step S212), the CPU 411 ends the flow.

Furthermore, if, in step S201, it is determined that sheet feeding from the manual feed tray 312 is not in progress (NO in step S201), the CPU 411 performs a normal lift-up operation in steps S213 to S217, and then ends the flow.

According to the above-described embodiment, lift-up in the cassette 201 can be completed at timing earlier than in the first embodiment.

In the above-described second embodiment, a method of performing a lift-up operation divided into a plurality of operations has been described. In a third embodiment, a method of performing a lift-up operation divided into a plurality of operations as in the second embodiment and continuing lift-up only for a predetermined time even after a sheet 8 fed from the manual feed tray 312 arrives at the photo-interrupter 300 is described. The description of main components such as those of the configuration is similar to that in the first embodiment, and, here, only portions different from those in the first embodiment are described.

Figure 9:
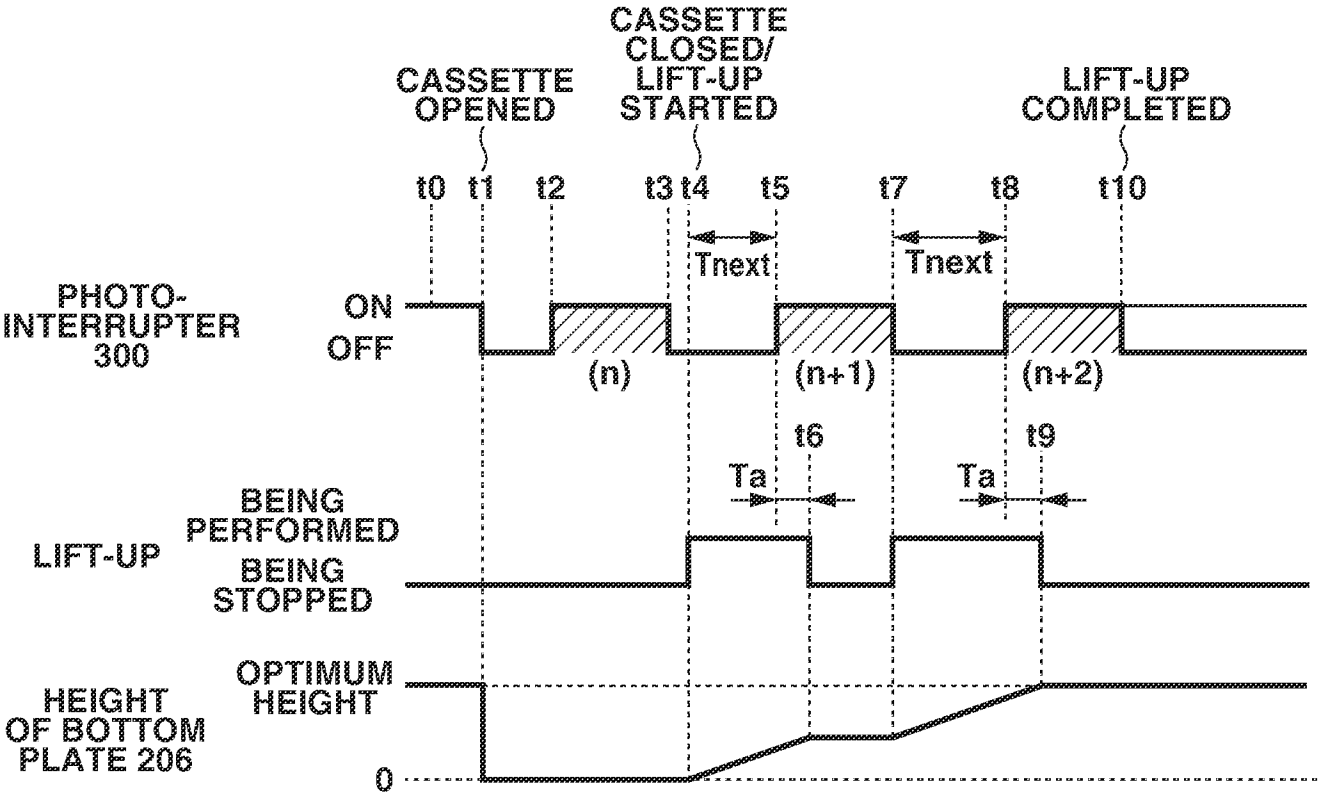
FIG. 9 is a timing chart illustrating lift-up control according to a third embodiment.

Lift-up control in the cassette 201 according to the third embodiment is described with reference to the timing chart of FIG. 9. In FIG. 9, the abscissa axis indicates time elapsing.

Operation performed until time point t4 is similar to that in the first embodiment and the second embodiment, and is, therefore, omitted from description. At time point t4, the cassette 201 is inserted into the printer 101 by the user. When the cassette presence or absence detection sensor 301 detects the insertion of the cassette 201, the CPU 411 calculates an interval time (Tnext) required until the leading edge of a next sheet 8 (the (n+1)-th sheet) arrives at the flag 302. In the present embodiment, as with the second embodiment, the CPU 411 starts lift-up at time point t4. The CPU 411 turns on the drive motor 227, turns on the solenoid 219, and monitors a signal output from the photo-interrupter 300 being changed from OFF to ON.

At time point t5, the time Tnext has elapsed and the leading edge of the sheet 8 (the (n+1)-th sheet) arrives at the flag 302, but, in the present embodiment, the CPU 411 continues the lift-up operation for a predetermined time (a time from time point t5 to time point t6, hereinafter referred to as a "time Ta"). The time Ta is a margin time in which, even when the bottom plate 206 continues rising after a signal output from the photo-interrupter 300 is changed from OFF to ON, it is assured that a sheet feeding performance provided by the pick-up roller 202 is not affected and the lift-up mechanism is not damaged. The time Ta is a constant previously stored in the ROM 411*a* (which is, in the present embodiment, set to 1 second).

At time point t6, since the time Ta has elapsed, the CPU 411 stops the lift-up operation. At this time point, since the sheet 8 (the (n+1)-th sheet) is in the process of passing the flag 302, the CPU 411 cannot determine whether the lift-up operation is completed. At time point t7, the trailing edge of the sheet 8 (the (n+1)-th sheet) passes the flag 302. At this time, the CPU 411 determines whether a signal output from the photo-interrupter 300 is ON or OFF. If the signal output from the photo-interrupter 300 is ON, the CPU 411 can determine that, during a period from time point t5 to time point t6, the sheet 8 located uppermost has pushed up the flag 302, so that a signal output from the photo-interrupter 300 has been changed to ON. Actually, at time point t7, since the signal output from the photo-interrupter 300 is OFF, the CPU 411 determines that the lift-up operation is not yet completed. Next, the CPU 411 calculates a time Tnext with respect to the sheet 8 (the (n+2)-th sheet). Then, the CPU 411 resumes the lift-up operation, and monitors a signal output from the photo-interrupter 300 being changed from OFF to ON.

At time point t8, the time Tnext has elapsed and the leading edge of the sheet 8 (the (n+2)-th sheet) arrives at the flag 302, but the CPU 411 continues the lift-up operation for the time Ta. At time point t9, since the time Ta has elapsed, the CPU 411 stops the lift-up operation. At this time point, since the sheet 8 (the (n+2)-th sheet) is in the process of passing the flag 302, the CPU 411 cannot determine whether the lift-up operation is completed. At time point t10, the trailing edge of the sheet 8 (the (n+2)-th sheet) passes the flag 302. At this time, since a signal output from the photo-interrupter 300 is ON, the CPU 411 determines that, during a period from time point t8 to time point t9, the sheet 8 located uppermost has pushed up the flag 302, so that a signal output from the photo-interrupter 300 has been changed to ON. With the above operation, at time point t10, the CPU 411 determines that the lift-up control has been completed.

The above-described operation is described with reference to the flowchart of FIG. 10. Control which is based on the flowchart of FIG. 10 is performed by the CPU 411 executing a program stored in, for example, the ROM 411*a*.

Processing performed until step S303 is similar to processing performed until step S203 in the second embodiment, and is, therefore, omitted from description. Following step S303, the CPU 411 starts a lift-up operation in steps S304 and S305, and monitors a signal output from the photo-interrupter 300 being changed from OFF to ON in step S306. If it is determined that the signal output from the photo-interrupter 300 is OFF (NO in step S306), then in step S307, the CPU 411 determines whether the time Tnext has elapsed. If it is determined that the time Tnext has elapsed (YES in step S307), the CPU 411 continues the lift-up operation for the time Ta. In step S308, the CPU 411 determines whether the time Ta has elapsed. If it is determined that the time Ta has elapsed (YES in step S308), the CPU 411 stops the lift-up operation by turning off the solenoid 219 in step S309 and turning off the drive motor 227 in step S310. In step S311, the CPU 411 determines whether the trailing edge of the sheet 8 has passed the flag 302. Then, if it is determined that the trailing edge of the sheet 8 has passed the flag 302 (YES in step S311), then in step S312, the CPU 411 determines whether a signal output from the photo-interrupter 300 is still ON. If it is determined that the signal output from the photo-interrupter 300 is OFF (NO in step S312), the CPU 411 repeats processing in steps S302 to S311. If, in step S312, it is determined that the signal output from the photo-interrupter 300 is still ON (YES in step S312), the CPU 411 determines that the lift-up operation has been completed and thus ends the flow.

If, in step S306, it is determined that the signal output from the photo-interrupter 300 is changed from OFF to ON (YES in step S306), the CPU 411 determines that the lift-up operation has been completed and thus ends the flow by turning off the solenoid 219 in step S313 and turning off the drive motor 227 in step S314. Furthermore, if, in step S301, it is determined that sheet feeding from the manual feed tray 312 is not in progress (NO in step S301), the CPU 411 performs a normal lift-up operation in steps S315 to S319, and then ends the flow.

As described above, in the present embodiment, since lift-up is performed even during a period in which the sheet 8 is passing the flag 302, a certain amount of lift-up can be performed even when the interval time is short. Then, lift-up in the cassette 201 can be completed at timing earlier than in the second embodiment.

While, in the above-described first to third embodiments, the printer 101 is described as an example of a feeding device which feeds a recording material, the present disclosure is not limited to this example. An example of the feeding device can be a feeding option device which feeds a recording material to the printer 101 and which is detachably attached to the printer 101.

Furthermore, while, in the above-described first to third embodiments, a laser beam printer is described as an example, an image forming apparatus of the disclosure is not limited to this, but can be a printer of another printing type, such as an inkjet printer, or a copying machine.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-169372 filed Aug. 31, 2016, which is hereby incorporated by reference herein in its entirety.

What is claimed is:

1. A feeding device comprising:

a first plate on which a recording material is placed;

a second plate located above the first plate in a vertical direction;

an uplift unit configured to uplift a recording material placed on the first plate;

a detection unit configured to detect the recording material uplifted by the uplift unit arriving at a feeding position, wherein a recording material fed from the second plate is detected by the detection unit when the recording material fed from the second plate passes the detection unit while the recording material placed on the first plate is not in the feeding position; and a control unit configured to cause a first recording material and a second recording material to be sequentially fed from the second plate, and to cause the uplift unit to uplift the recording material placed on the first plate in an interval time from when a trailing edge of the first recording material passes the detection unit to when a leading edge of the second recording material arrives at the detection unit.

2. The feeding device according to claim 1, wherein the control unit does not cause the uplift unit to uplift the recording material placed on the first plate in a time from when a leading edge of the first recording material arrives at the detection unit to when the trailing edge of the first recording material passes the detection unit or a time from when the leading edge of the second recording material arrives at the detection unit to when a trailing edge of the second recording material passes the detection unit.

3. The feeding device according to claim 2, wherein, in a case where a maximum time required to uplift the recording material placed on the first plate to the feeding position is shorter than the interval time, the control unit causes the uplift unit to uplift the recording material placed on the first plate to the feeding position in the interval time, and, in a case where the maximum time is longer than or equal to the interval time, the control unit does not cause the uplift unit to uplift the recording material placed on the first plate to the feeding position in the interval time.

4. The feeding device according to claim 2, wherein the control unit causes the uplift unit to uplift the recording material placed on the first plate in a plurality of interval times.

5. The feeding device according to claim 1, wherein the control unit causes the uplift unit to continue uplifting the recording material placed on the first plate for a predetermined time even after the leading edge of the second recording material arrives at the detection unit.

6. The feeding device according to claim 5, wherein the detection unit includes a flag configured to be rotated by contacting the recording material placed on the first plate, and a photo-interrupter configured to output a signal according to a position of the flag, and wherein the predetermined time is a margin time in which the flag is not damaged.

7. The feeding device according to claim 1, wherein the first plate is a cassette detachably attached to the feeding device, and wherein, in a case where the cassette is detached from the feeding device and is then re-attached to the feeding device, the uplift unit uplifts the recording material placed on the first plate until the detection unit detects the recording material placed on the first plate.

8. A method for a feeding device having a first plate on which a recording material is placed, a second plate located above the first plate in a vertical direction, and an uplift unit configured to uplift a recording material placed on the first plate, the method comprising:

detecting the recording material uplifted by the uplift unit arriving at a feeding position, wherein a recording material fed from the second plate is detected by the detection unit when the recording material fed from the second plate passes the detection unit while the recording material placed on the first plate is not in the feeding position; and causing a first recording material and a second recording material to be sequentially fed from the second plate, and causing the uplift unit to uplift the recording material placed on the first plate in an interval time from when a trailing edge of the first recording material passes the detection unit to when a leading edge of the second recording material arrives at the detection unit.

* * * * *